US005230381A

United States Patent [19]

Nara et al.

[11] Patent Number: 5,230,381

[45] Date of Patent: Jul. 27, 1993

[54] METHOD AND APPARATUS FOR MANUFACTURING A THIN METAL STRIP BY QUENCHING AND SOLIDIFICATION

[75] Inventors: Seiko Nara; Kiyoshi Shibuya; Toru Sato; Kyoji Nakanishi, all of Chiba, Japan

[73] Assignee: Kawasaki Steel Corporation, Kobe, Japan

[21] Appl. No.: 910,575

[22] Filed: Jul. 8, 1992

[30] Foreign Application Priority Data

Jul. 16, 1991 [JP] Japan ..... 3-199865

[51] Int. Cl.[5] ..... B22D 11/06; B22D 11/00

[52] U.S. Cl. ..... 164/463; 164/423; 164/475; 164/415

[58] Field of Search ..... 164/463, 423, 479, 429, 164/475, 415

[56] References Cited

FOREIGN PATENT DOCUMENTS 266046 3/1989 German Democratic Rep. ..... 164/463

56-163235 12/1981 Japan ..... 164/463

*Primary Examiner*—Kuang Y. Lin

*Attorney, Agent, or Firm*—Dvorak and Traub

[57] ABSTRACT

A gaseous atmosphere having a predetermined composition is formed near an injected molten metal flow and an injection nozzle of the atmospheric gas so as to manufacture a thin metal strip exhibiting excellent surface property. A thin strip manufacturing apparatus includes an injection nozzle 1 for injecting a molten metal onto a cooling roll 2, an atmospheric gas injection nozzle 3 for injecting an atmosphere having a predetermined composition, a sensor 5 for measuring the concentration of the atmospheric gas, a control device 6 for adjusting a flow rate of the atmospheric gas on the basis of the output of the sensor 5, a cover 4 for maintaining the concentration of the atmospheric gas, and a heating device for preventing cooling of the injection nozzle 1.

5 Claims, 4 Drawing Sheets

$O_2$ ATMOSPHERE $CO_2$ ATMOSPHERE

ATMOSPHERE

METHOD AND APPARATUS FOR MANUFACTURING A THIN METAL STRIP BY QUENCHING AND SOLIDIFICATION

BACKGROUND OF THE INVENTION

1. Field of the Invention

The present invention relates to a method of manufacturing a high-quality thin metal strip by injecting a molten metal onto a cooling roll in an oxidized atmosphere gas. The presence of the oxidized atmosphere gas stabilizes the molten metal. Subsequent cooling and solidifying of the stabilized molten metal results in a thin metal strip having excellent surface properties.

2. Description of the Related Art

Conventionally, a thin metal strip is manufactured directly from a molten metal by causing the molten metal to flow from a nozzle onto the peripheral surface of a cooling roll which is rotating at a high speed. The molten metal is then cooled and solidified on the peripheral surface of the roll. This manufacturing method is classified as either a single roll method or a twin roll method.

The single roll method is suitable for the manufacture of a wide thin metal strip.

In the single roll method, a molten metal is injected from the nozzle toward the roll which is being rotated at a high speed and the molten metal forms a thin deposit on the surface of the roll. As the molten metal is cooled and solidified it becomes amorphous. This amorphous metal is then continuously peeled off the roll surface by the centrifugal force generated by the rotation of the roll to form the thin metal strip. The thin strip has a thickness of 50 μm or less and is manufactured at a speed of 20 m/sec or more.

In the conventional casting, the atmosphere remains substantially at rest with respect to the molten metal and deterioration of the surface properties due to the engulfing of air by the metal does not occur. If deterioration of the surface properties does occur, however, the surface properties can be improved by descaling or rolling which is performed in a subsequent process.

The conventional casting techniques for improving the surface properties of metals cannot be used on thin metal strips manufactured by these methods. Descaling or rolling cannot be performed in the manufacture of a thin metal strip by the single roll method because manufacturing speed is very high and the thickness of the metal strip is very thin.

Japanese Patent Laid-Open No. 58-141837 provides a gas interrupting member having a passageway for a high-speed gas stream therein to interrupt the high-speed gas flow which is generated near the surface of the roll by the rotation of the cooling roll and which adversely affects the cooling roll, nozzle and molten metal puddle. The gas interrupting member is an inverted U-shaped thin tube. The opening of the passageway which is formed remote from the roll is an inlet, and the opening thereof located close to the roll is an outlet. The cross-sectional area of the interrupting member gradually reduces toward the outlet.

However, in the method disclosed in Japanese Patent Laid-Open No. 58-141837, although only a certain amount of air flow near the surface of the roll can be interrupted, a high-speed gas flow near the roll surface cannot be interrupted. The present inventors discovered that there was no change in the surface property between the thin metal strip manufactured by this method and the conventional thin metal strip.

Japanese Patent Laid-Open No. 54-50430 discloses the method of improving the surface property of a thin metal strip by manufacturing the same while absorbing the gas which adversely affects the surface of the thin strip near the roll, nozzle and molten metal puddle. The present inventors actually manufactured a thin metal strip by this method and found that turbulence of the gas near the roll and nozzle could be eliminated.

However, the turbulence of the high-speed gas flow which is associated with the improvement in the surface properties of the thin strip occurs at a position which is separated from the surface of the roll by 100 μm or less, and the high-speed gas flow at such a site could not be eliminated. The manufactured thin metal strip had the surface property which was substantially the same as that of the conventional thin metal strip.

The methods of improving the surface properties of a thin metal strip by interrupting the flow of the gas near the surface of the roll described above cannot completely solve the problem involving the surface properties of the thin strip.

Japanese Patent Laid-Open No. 62-166058 discloses a new method of improving the surface properties of a thin metal strip by using a cooling roll mainly made of iron. This method is directed to eliminating the engulfing of gas into the interface between the cooling roll and the molten metal puddle formed on the cooling roll by the gas flow generated near the surface due to an increased wettability between the roll and the molten metal which is obtained when the thin metal strip mainly made of iron is manufactured.

The present inventors actually manufactured the thin metal strip by this method and found that some types of molten metal attached to the cooling roll made of iron-based metal. In such a case, the property of the manufactured thin strip was not excellent. The present inventors also found that cooling was not conducted completely due to a small coefficient of thermal conductivity when an amorphous thin metal strip was manufactured. A crystallized thin strip was obtained in place of the amorphous one. Also, the thus-obtained thin strip did not have a ribbon-like shape but a sea weed-like shape and was stretched at the two edges thereof. Although the obtained thin strip had better surface properties than the conventional thin strip, the properties of the entire thin strip was worse than the conventional one. This method cannot be applied to the manufacture of an amorphous thin metal strip because of occurrence of crystallization.

Hence, the following problems of the conventional techniques must be solved to improve the surface property of the thin metal strip.

(1) The most important issue is to prevent deterioration in the surface properties of the thin strip caused by a turbulence of the puddle produced on the surface of the cooling roll. The turbulence is due to the high-speed gas flow generated near the surface of the cooling roll by the rotation thereof.

(2) The second issue is to satisfy the general properties and magnetic characteristics of the thin metal strip.

SUMMARY OF THE INVENTION

An object of the present invention is to provide a method and apparatus for manufacturing a thin metal strip having improved surface qualities by cooling and solidification.

According to one aspect of the present invention, there is provided a method of manufacturing a thin metal strip by injecting a molten metal from a nozzle onto the surface of a single cooling roll which is rotating at a high speed. The method is characterized by the formation of an atmospheric gas near the injected molten metal flow and a gas injection nozzle. The gas is composed of 23 vol % or more of oxygen and a balance of an inactive or inert gas.

The atmospheric gas may be directly blown proximate the injected molten metal flow.

According to another aspect of the present invention, there is provided a method of manufacturing a thin metal strip by injecting a molten metal from a nozzle onto the surface of a single cooling roll which is rotating at a high speed. The method is characterized by the formation of an atmospheric gas near the injected molten metal flow and a gas injection nozzle. The gas is composed of 35 vol % or more of a gas whose composition consists of x vol % of oxygen and y vol % of at least one type of oxidizing gas where $x+y=100$ and $x \geqq 20$ and a balance of an inactive gas.

The atmospheric gas may be directly blown proximate the injected molten metal flow.

The present invention also provides an apparatus for manufacturing a thin metal strip by injecting a molten metal from a nozzle onto the surface of a single cooling roll which is rotating at a high speed. The apparatus includes an atmospheric gas injection nozzle for injecting a gas having a predetermined composition proximate the injected molten metal flow, a concentration measuring device for measuring the concentration of the atmospheric gas, a control unit for adjusting the flow rate of the gas on the basis of the output of the concentration measuring device, and a cover for maintaining the concentration of the gas.

DESCRIPTION OF THE PREFERRED EMBODIMENTS

Figure 1:
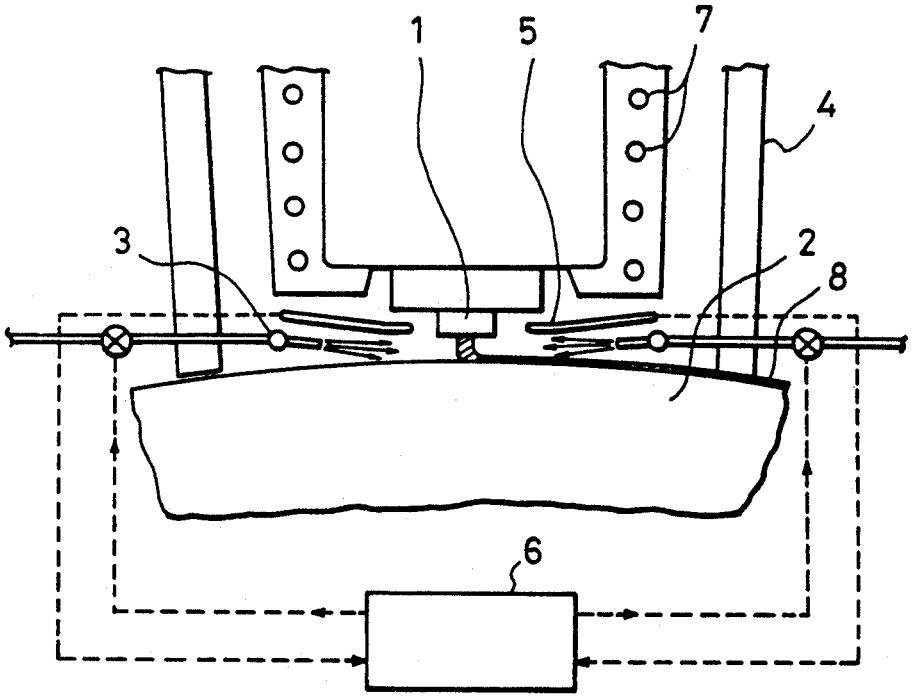
FIG. 1 illustrates an embodiment of the apparatus according to the present invention.

An embodiment of the present invention will be described below with reference to FIG. 1. In the apparatus of the present invention, a molten metal is injected from a nozzle 1 onto a rotating cooling roll 2 thereby forming a thin metal strip 8. The thin metal strip 8 is then cooled and solidified by the cooling roll 2. A gas is injected from gas nozzles 3 to form a gaseous atmosphere near the molten metal injected from the injection nozzle. A cover 4 maintains the atmosphere formed by the gas injected from the gas nozzles 3. A sensor 5 measures the concentration of the atmospheric gas. A control device 6 controls the flow rate of the gas supplied from the gas nozzles 3 on the basis of the output of the sensor 5. A nozzle heating device 7 is provided to prevent cooling of the injection nozzle 1.

The thin metal strip is manufactured in the manner described below using the apparatus and method according to the present invention.

When the atmospheric concentration of oxidizing gas, oxygen or a mixture of the oxidizing gas and oxygen reaches 30 vol % or more, manufacture of the thin metal strip is initiated. Since the puddle formed by the molten metal is stabilized by the presence of the gas and the puddle is readily deposited on the cooling roll, the engulfing of decomposed gas, oxygen, a gas mixture or other gas between the puddle and the cooling roll is substantially eliminated. Even if any gas is present, the amount thereof is so small that substantially all of the gas is absorbed by the time the molten metal is turned into the thin strip. Thus, the manufactured thin strip exhibits excellent surface properties.

The surface properties of the thin strip located close to the surface of the roll has been described. Improvement in the surface properties of the thin strip located close to the roll surface results in improvement in the surface properties of the free surface of the thin strip located remote from the roll surface. Thus, it is possible to obtain a thin strip which has excellent surface properties on two surfaces.

It is therefore possible to manufacture a thin metal strip having a continuous surface and exhibiting improved surface properties as compared to that of conventional apparatuses and methods.

The present inventors have conducted experiments using different atmospheric gas concentrations having various compositions with the apparatus according to the present invention.

Figure 2:
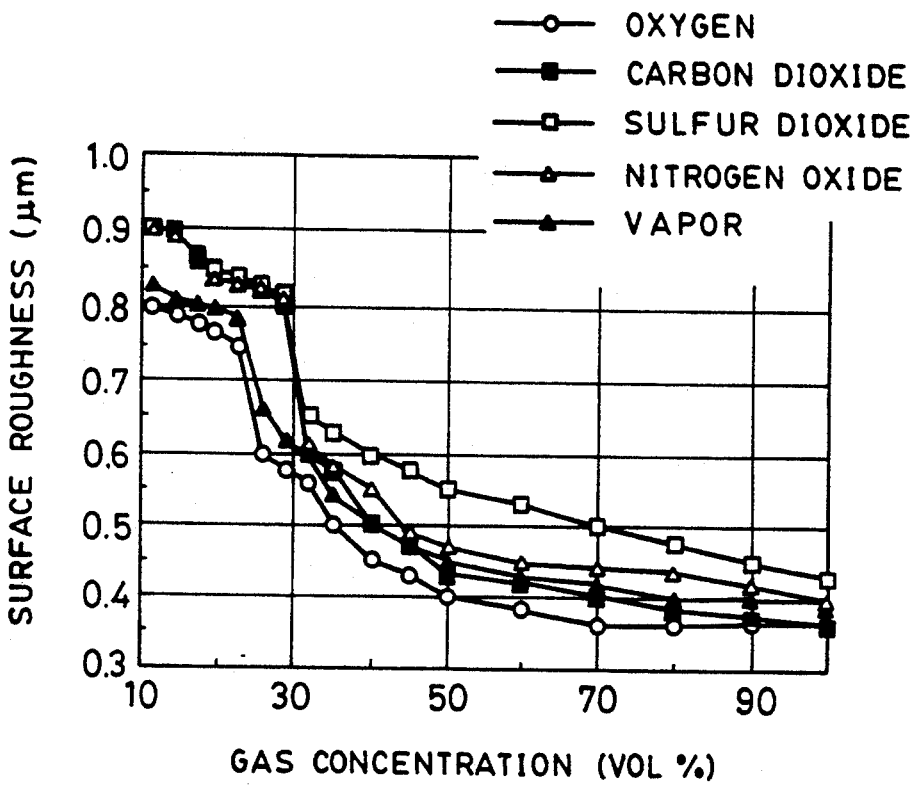
FIG. 2 is a graph illustrating the relation between the atmospheric gas concentration of various compositions versus the surface roughness of the manufactured thin strips.
Figure 3:
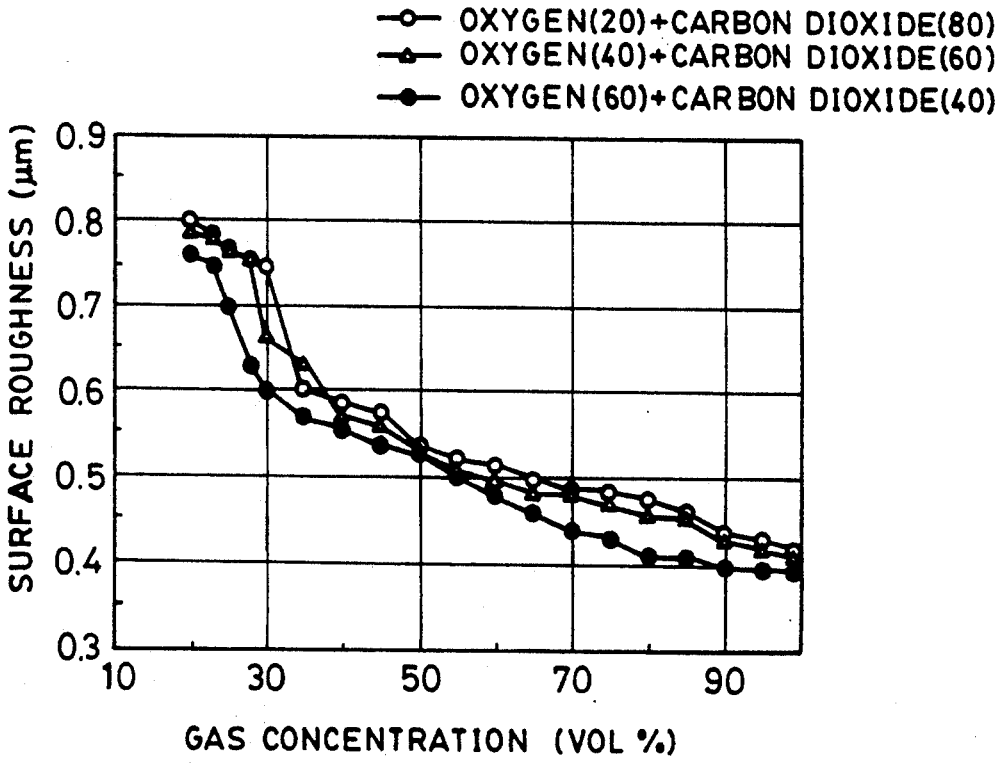
FIG. 3 is a graph showing the relation between the atmospheric gas concentration of various compositions versus the surface roughness of the manufactured thin strips.

FIGS. 2 and 3 are graphic representations of the surface roughness of the thin strips actually manufactured using oxygen and oxidizing gases. The ordinate axis represents the average roughness of the free surface and roll surface (the center line average roughness Ra (μm)). The abscissa axis represents the gas concentration for the various compositions. It is clear from these graphs that the surface roughness can be improved with oxygen gas having an atmospheric concentration of 22% or more. Particularly, oxygen is remarkably effective when the atmospheric concentration thereof is 25% or more.

Under the foregoing conditions, there was no change in the general characteristics of the manufactured thin strips. Improvement in the surface property thereof increased the space factor thereof. Thus, for example, when the thin strip manufactured by the method and apparatus of the present invention is used as an iron core for a transformer, the overall size of the transformer can be reduced due to an increase in the space factor.

EXAMPLE

An example of the present invention will be described below.

After a molten metal whose composition was Fe80-B10-Si9-C1 (atomic percentage) was heated to 1300° C., it was injected from a slit-shaped nozzle having a width of 200 mm onto a copper alloy cooling roll which was rotating at a high speed (25 m/sec) to obtain a 25 μm thick amorphous thin metal strip 8.

The results of the experiments concerning the relation between the surface properties of the manufactured thin strips and the gaseous atmospheres are shown in FIG. 2. It is clear from FIG. 2 that the surface property of the thin strip can be improved when it is manufactured using oxygen and a gas in which oxygen is present in a combined state.

Figure 4A:
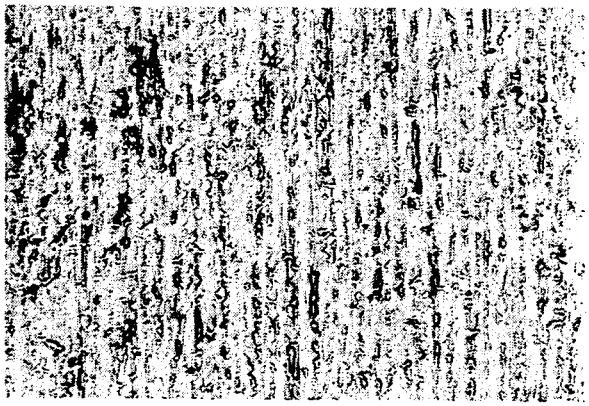
FIG. 4(*a*)-4(*c*) are microphotographs (×100) of the surface roughness of the thin metal strips manufactured by using various gas compositions.
Figure 4B:
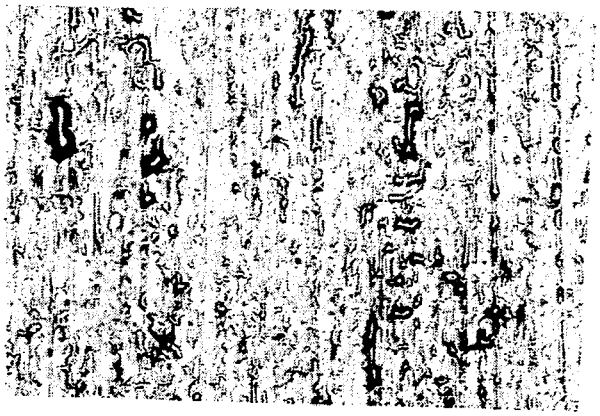
Figure 4C:
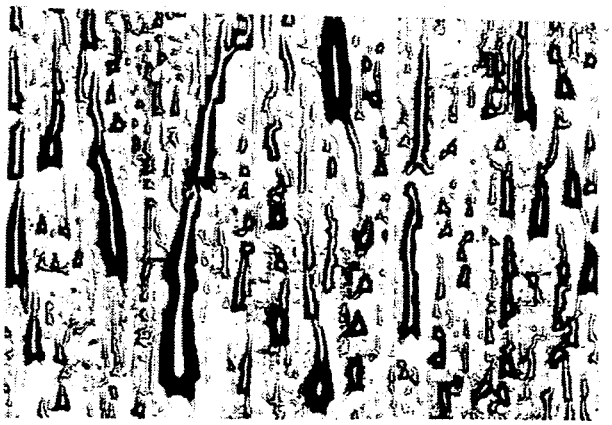

FIG. 4 shows the microphotographs of the surface of the thin strips actually manufactured in various types of gaseous atmospheres. FIG. 4(*a*) is a microphotograph of the thin strip manufactured in the oxygen atmosphere (34 vol %). Ra was 0.50 μm. FIG. 4(*b*) is a microphotograph of the thin strip manufactured in the carbon dioxide atmosphere (30 vol % or more) whose Ra was 0.60 μm. FIG. 4(*c*) is a microphotograph of the thin strip manufactured in the atmosphere. Ra was 0.82 μm. It is apparent from these microphotographs that excellent thin strips can be manufactured in an oxygen atmosphere.

It is therefore possible according to the present invention to manufacture thin strips having improved surface properties.

What is claimed is:

1. A method of manufacturing a thin metal strip by injecting a molten metal from a nozzle onto a surface of a single cooling roll which is rotating at a high speed and thereby quenching and solidifying the molten metal, the improvement being characterized by providing an atmosphere composed of 23 vol % or above of oxygen and a balance of an inactive gas near the injected molten metal flow and an injection nozzle of the gas.

2. A method of manufacturing a thin metal strip by quenching and solidification according to claim 1, wherein the atmosphere is formed by blowing the atmospheric gas directly to the injected molten metal flow.

3. A method of manufacturing a thin metal strip by injecting a molten metal from a nozzle onto a surface of a single cooling roll which is rotating at a high speed and thereby quenching and solidifying the molten metal, the improvement being characterized by providing an atmosphere composed of 35 vol % or above of a gas whose composition consists of x vol % of oxygen and y vol % of at least one type of oxidizing gas where $x+y=100$ and $x \geqq 20$ and a balance of an inactive gas, near the injected molten metal flow and an injection nozzle for the gas.

4. A method of manufacturing a thin metal strip by quenching and solidification according to claim 3, wherein the atmosphere is formed by blowing the atmospheric gas directly to the injected molten metal flow.

5. An apparatus for manufacturing a thin metal strip by injecting a molten metal from a nozzle onto a surface of a single cooling roll which is rotating at a high speed and thereby quenching and solidifying the molten metal, the improvement being characterized by the inclusion of an atmospheric gas injection nozzle for injecting an atmosphere having a predetermined composition near the injected molten metal flow; a concentration measuring device for measuring a concentration of the atmospheric gas; a control unit for adjusting a flow rate of the atmospheric gas on the basis of the output of the concentration measuring device; and a cover for maintaining the concentration of the atmospheric gas.

* * * * *